US011475868B1

(12) United States Patent
Dileone, Jr.

(10) Patent No.: US 11,475,868 B1
(45) Date of Patent: Oct. 18, 2022

(54) ELECTRIC PIANO WITH ADJUSTABLE PICKUP RAIL

(71) Applicant: Vintage Vibe LLC, Rockaway, NJ (US)

(72) Inventor: Alfred J. Dileone, Jr., Hamden, CT (US)

(73) Assignee: Vintage Vibe LLC, Rockaway, NJ (US)

( * ) Notice: Subject to any disclaimer, the term of this patent is extended or adjusted under 35 U.S.C. 154(b) by 0 days.

(21) Appl. No.: 17/576,356

(22) Filed: Jan. 14, 2022

(51) Int. Cl.
*G10H 3/20* (2006.01)
*G10H 1/34* (2006.01)
*G10H 1/00* (2006.01)

(52) U.S. Cl.
CPC ..... *G10H 3/20* (2013.01); *G10H 1/0008* (2013.01); *G10H 1/348* (2013.01); *G10H 2220/221* (2013.01); *G10H 2220/461* (2013.01)

(58) Field of Classification Search
CPC ..... G10H 3/20; G10H 1/0008; G10H 1/348; G10H 2220/221; G10H 2220/461
See application file for complete search history.

(56) References Cited

U.S. PATENT DOCUMENTS 2,469,667 A 5/1949 Rhodes
2,919,616 A 1/1960 Miessner
2,932,231 A 4/1960 Miessner
2,942,512 A 6/1960 Miessner
2,966,821 A 1/1961 Miessner
2,972,922 A 2/1961 Rhodes
3,038,363 A 6/1962 Miessner
3,041,909 A 7/1962 Miessner
3,077,137 A 2/1963 Miessner
3,270,608 A 9/1966 Rhodes
3,285,116 A 11/1966 Rhodes
3,384,699 A 5/1968 Rhodes
3,418,417 A 12/1968 Rhodes
3,541,915 A 11/1970 Rhodes
3,644,656 A 2/1972 Fender et al.
4,058,044 A * 11/1977 Murakami ..... G10D 13/09 84/723
4,324,164 A * 4/1982 Monte ..... G10C 3/20 984/372
4,338,848 A 7/1982 Rhodes
4,342,246 A 8/1982 Rhodes et al.
4,373,418 A 2/1983 Rhodes et al.
9,514,725 B1 * 12/2016 Brandstetter ..... G10H 3/12
2010/0326261 A1 * 12/2010 Stevens ..... G10H 1/32 84/746

* cited by examiner

*Primary Examiner* — Jeffrey Donels
(74) *Attorney, Agent, or Firm* — Pearl Cohen Zedek Latzer Baratz LLP

(57) ABSTRACT

An electric piano is provided with a movable pickup rail to globally alter the harmonic and fundamental characteristics of the piano tone by manipulating the vertical position of the pickup rail relative to an array of tone producing elements. The apparatus permits global tone adjustment that can be locked in place or adjusted on the fly in a performance setting for example.

19 Claims, 7 Drawing Sheets

ELECTRIC PIANO WITH ADJUSTABLE PICKUP RAIL

BACKGROUND OF THE INVENTION

The invention is directed to electric pianos using an array of vibrating tone elements and a corresponding array of electric transducers ("pickups"), including pianos based on Fender Rhodes brand, Rhodes brand, and Wurlitzer brand designs.

U.S. Pat. No. 3,384,699 to Harold Rhodes teaches an electric piano in which the tone producing element comprises an elongated tine which is struck by a hammer and caused to vibrate. Positioned above and coupled to the tine is a much heavier part of the tone producing element called the "resonator." Together, the resonator and the tine (referred to collectively as the "tone producing element") produce a vibration at a desired frequency for a given piano note. An array of such tone producing elements is positioned opposite a corresponding array of transducers or "pickups." Each pickup in the array has a wire coil wrapped around a core and electrical leads carrying the induced electrical signal from the pickup. In the now conventional "Rhodes" design, tone adjustment may be achieved by manipulating one or two screws of a mounting system of the tone producing element to pivot the element relative to a corresponding pickup. When adjusting the tone of a conventional Rhodes piano, a user needs to manipulate the angle of each individual tone source in relation to the pickup for a desired sound. Manipulation of individual pickups on a vertical axis is generally not possible and moving these elements would pose a challenge in any event, because of the leads and for other reasons. The Rhodes '699 patent is incorporated by reference for its teaching of the prior art tone producing elements and means of positioning them, which would be known to a person of ordinary skill in the art.

U.S. Pat. No. 2,974,555 to Andersen, which is also incorporated by reference, teaches an alternative tone generation and pickup system for an electric piano associated with a Wurlitzer brand design. A tone producing element in the Wurlitzer design comprises a tuned reed for each piano note vibrating in a respective space formed between fingers in a planar pickup plate. The tone of individual notes may be adjusted by bending the ends of the fingers on opposite sides of a reed, thereby adjusting the position of the ends of the pickup relative to the maximum amplitude of the vibration of the reed, which modulates the tone toward the harmonic or the fundamental, because the harmonic tone is associated with a planar alignment of the reed and the pickup fingers. Each pickup is adjustable to obtain consistent tonal characteristics (voicing) throughout all the notes, which is a very time-consuming process. As with the original Fender Rhodes design, the conventional Wurlitzer apparatus affords no ability to globally set and modify tone for all the notes on the piano on the fly, during a performance for example.

SUMMARY OF THE INVENTION

One object of the invention is to provide a mechanism to apply a desired tone, varying between fundamental and harmonic modes, instantly and globally by manipulating the position of an array of pickups relative to an array of tone producing elements, rather than adjusting individual tone sources. Another object is to permit tone adjustment without affecting piano action, including strike-line, escapement and damper adjustment, all of which are conventionally altered when an individual tone source is moved or adjusted.

In one aspect, the invention is embodied in an electric piano having a harp frame, a horizontal array of tone producing elements arranged on the harp frame, wherein each tone producing element comprises an elongated tine having a longitudinal axis and a resonator. The piano includes a horizontal array of keys, each key adapted to activate a respective hammer to strike a respective tone producing element. A horizontal array of tone pickup elements is provided opposite the array of tone producing elements, each pickup element having a pickup surface area generally perpendicular to the longitudinal axis of a respective tine. In embodiments, the array of tone pickup elements is connected to a pickup rail moveably connected to the harp frame; wherein the pickup rail is adjustable vertically to allow for up and down movement of the array of pickup elements, thereby adjusting a global vertical alignment of the pickup surface areas with the longitudinal axes of the respective tines.

Where a pickup comprises a coil wrapped around a core, a cross section of the coil projects a pick-up surface area at the end of the pickup facing the tone producing element which area is arranged generally perpendicularly to the longitudinal axis of a respective tine. The position of the pickup surface area in relation to the longitudinal axis of the respective tines determines the type of tone when a key is depressed. If the tine is aligned with the center of the pickup surface area, then a harmonic mode is produced. On the other hand, if the tine lines up closer to the top or bottom sides of the pickup surface area, then a fundamental mode is produced. According to embodiments of the invention, vertical movement of the pickup rail affects the tone for all the pickups globally, allowing for global tone adjustment between fundamental and harmonic modes, as well as for setting a desired tone combining these modes.

In embodiments, an electric piano according to the invention comprises a control arm connected at a first end to the pickup rail and extending over the harp frame. In this embodiment, the pickup rail has a front side toward the array of keys and a rear side opposite the front side; wherein the pickup rail has a fulcrum point toward the rear side where the pickup rail is connected to the harp frame, and the pickup rail is adapted to pivot about the fulcrum point and move the pickup elements vertically when the control arm is lifted. In another embodiment, the pickup rail may translate vertically in grooves in the harp frame, which vertical movement could likewise be automated or mechanically assisted, although this would require more elaborate reconfiguration of the conventional design. In embodiments, the pickup rail may be fixed at the bass and treble ends and may be adapted to flex in a middle portion of the range to adjust a tone in the middle range.

In embodiments, the control arm may be attached to a slide control unit exterior of the harp frame adapted to adjust a vertical position of the control arm, so that moving a lever horizontally (for example) allows a support to exert upward motion on a pin actuating the control arm to raise and lower the pickup rail. This action may be motorized, activated by a foot pedal, or other automation.

In embodiments, a locking pin is provided to fix a position of the pickup rail relative to the array of tone producing elements, so that an array of tone producing elements fixedly attached to a tone rail and resting on the harp frame can be lifted to access the piano action the without affecting the relationship of the pickups and the tone producing elements and the resulting tonal characteristics.

In other embodiments, an electric piano according to the invention may comprise a horizontal array of keys wherein each key is adapted to activate a respective hammer to strike a respective tone producing element; a horizontal array comprising a plurality of said tone producing elements arranged on a fixed tone rail; a horizontal array of tone pickup elements arranged on a pickup rail, each said pickup element corresponding to one respective tone producing element; wherein the pickup rail is adjustable with respect to the harp frame thereby adjusting global vertical alignment of the pickup elements with the tone producing elements, so that a tone of said electric piano across all notes is set by a user between fundamental and harmonic modes.

In another aspect, the invention is embodied as a method of globally adjusting an electric piano comprising a horizontal array of tone producing elements arranged on a tone bar on a piano harp frame, each tone producing element having a tine having a longitudinal axis; a horizontal array of tone pickup elements each having a surface area facing and aligned with the longitudinal axis of a respective tine; the plurality of tone pickup elements connected to a pickup rail; said pickup rail connected to a control arm extending from the pickup rail over the harp frame; the method comprising: lifting and lowering the control arm vertically to allow for up and down movement of the array of pickup elements, changing the alignment of the pickup elements' surface areas with the respective tines. The method may include lifting the array of tone producing elements from the harp frame in a fixed relationship to the pickups.

In another embodiment, the method of tone adjustment comprises locking a position of the pickup rail relative to the tone bar and lifting the array of tone producing elements in fixed relation to the pickups to access the piano action or the tuning springs, for example.

In another embodiment, the method of tone adjustment comprises mechanically assisted lifting and lowering of the pickup rail by a user of the electric piano on the fly.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
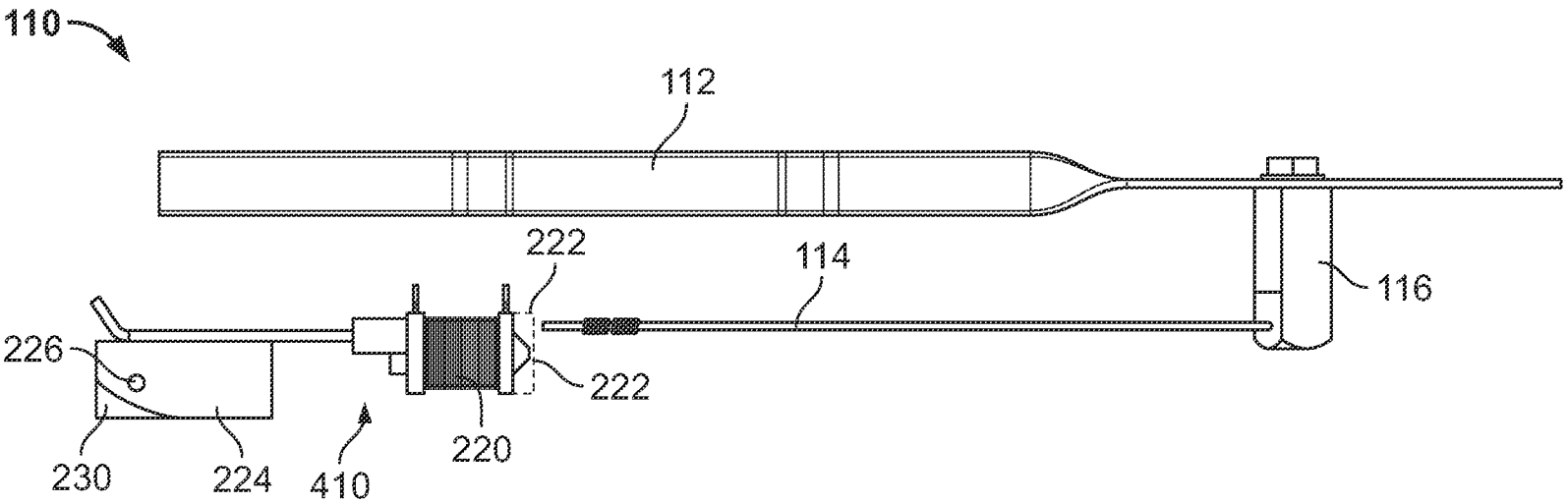
FIG. 1 depicts an adjustable pickup rail at rest (fundamental position) according to one embodiment.

It will be appreciated that for simplicity and clarity of illustration, elements shown in the figures have not necessarily been drawn to scale and some elements not necessary for an understanding of the invention have been omitted. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Orienting directions herein, such as "up" and "down," and "vertical" and "horizontal," are approximate and relative to a piano as normally used and played for the purpose of generally orienting the elements in the description. Thus, in an electric piano described herein, the electric piano comprises a "horizontal" array of keys and of tone producing elements and of tone pickup elements—referring to the relationship of the keys to each other, or the tone producing elements or pickups to each other. Likewise, the pickup rail may be adjustable "vertically" to allow for "up" and "down" movement of the pickup elements—referring to the relationship of the pickup elements to the tone producing elements—notwithstanding that the pickup rail may be pivoted, or even flexed, and not translated vertically as a unit. The user sits or stands at the "front" of the piano, and the pickup rail is on the opposite "rear" side. A surface (such as a pickup surface) is said to be "generally" perpendicular to an axis (such as a longitudinal axis of a tine) when it varies no more than +/−10° from perpendicular.

With conventional electric pianos, a technician can adjust for a desired tone ranging from fundamental to harmonic modes by manipulating the tone producing element, thereby changing the position of the tine in relation to the pickup element. The inventor herein became aware of an inherent flaw in the conventional method and design of tone adjustments, in that there is no ability to adjust the tones quickly and globally. This is because manipulating the angle of one tone producing element requires the need to change all of them in order to maintain tonal consistency. As there is a single tone producing element for each respective keystick on a piano, the current method can be time-consuming. Furthermore, any adjustment to the tone producing element will also alter the piano action, including the strike-line, escapement and damper adjustment. This type of adjustment cannot be made during a performance and typically is done by a technician and not an end user.

An electric piano according to embodiments of the invention comprises a horizontal array of piano keys and a corresponding array of tone producing elements toward the front of the piano and a horizontal array of tone pickup elements opposite the array of tone producing elements. The array of tone producing elements and tone pickup elements may be connected in a harp assembly which may be connected by a hinge to the piano so that the harp assembly may be lifted to access components for tuning and action adjustment. In some designs, the pickup element has a pickup surface area defined by a cross section of an induction coil that is generally perpendicular to a longitudinal axis of a respective tine in the tone producing element and the coil is wrapped around a core. Thus, the pickup surface area may be a projected surface area defined by the cross section of the coil. However, configurations of tone producing elements and pickup elements differ. It is within the scope of the invention to provide for global manipulation of an alignment of pickups and tone producing elements by vertically moving a common pickup rail, whatever design of tone generation and transducer is used. In embodiments, individual mountings of the tone producing elements and/or pickup elements are provided to allow for voicing of individual notes on the piano as well.

Figure 4:
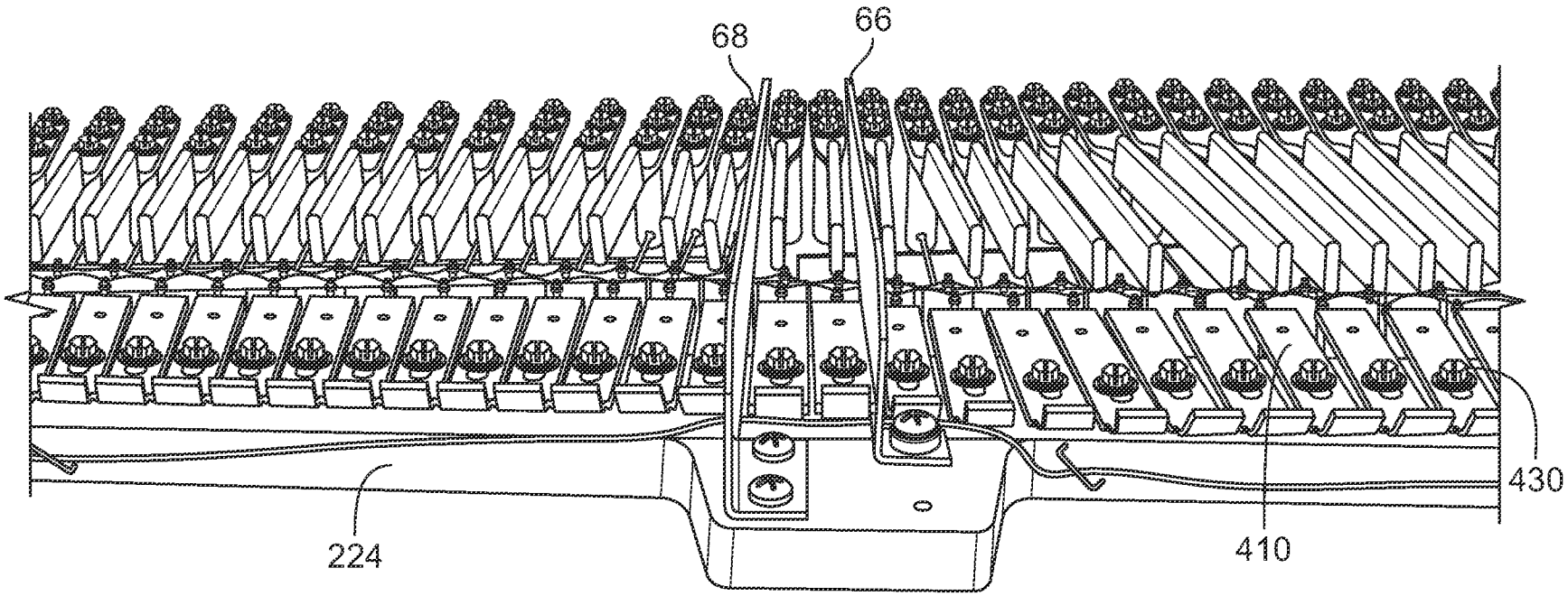
FIG. 4 depicts a control arm and support arm extending over the entire harp frame according to an embodiment.
Figure 5:
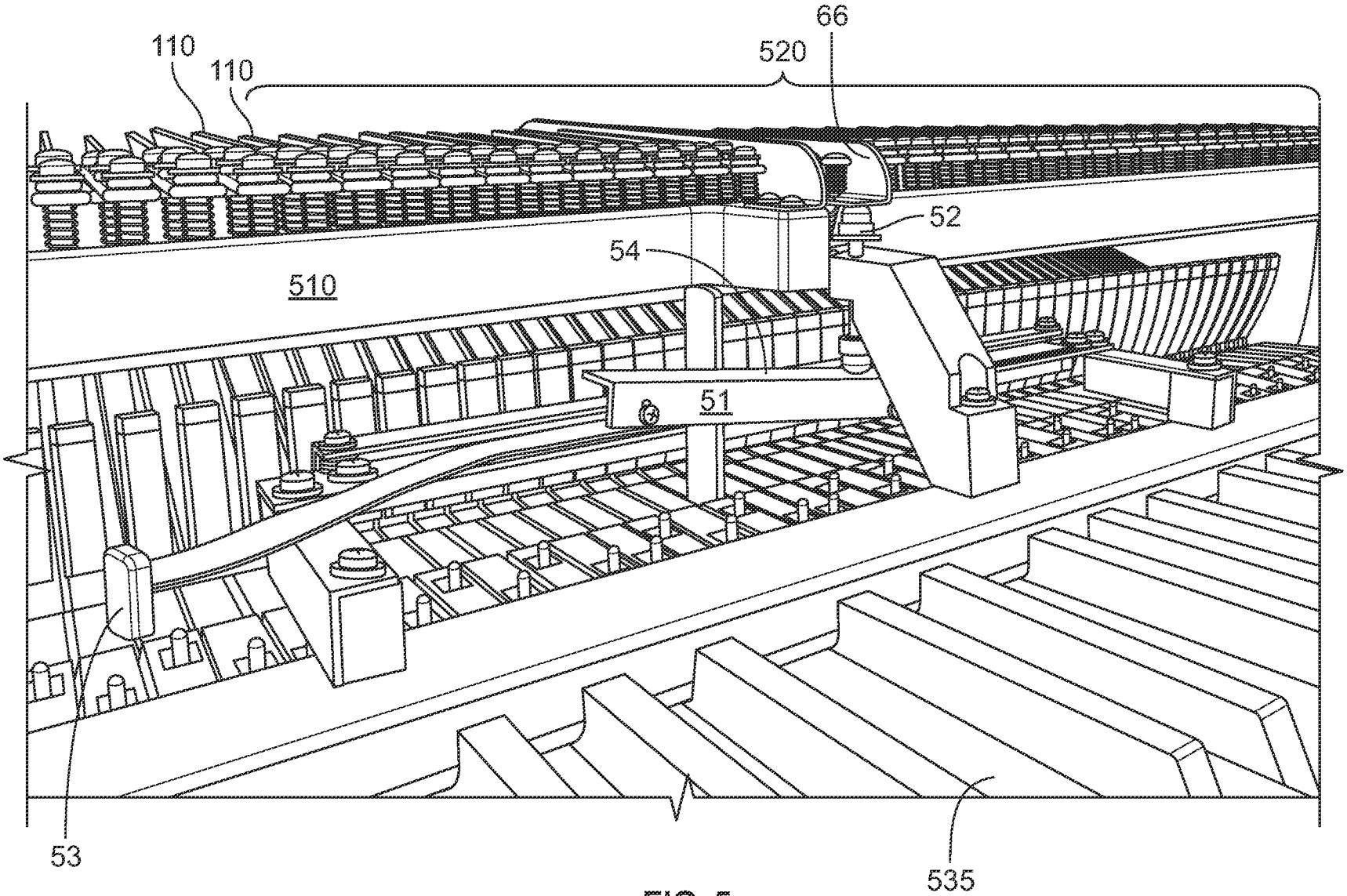
FIG. 5 schematically depicts a mechanism for manually operating the control arm with a slide control unit, showing the position when the pickup rail is at rest (fundamental position) according to an embodiment.

FIG. 1 depicts a tone producing element 110 comprising resonator 112 and tine 114 joined at mounting 116 according to an embodiment of the invention. A view from the front of a piano, in an embodiment depicted in FIG. 5, shows a horizontal array 520 of tone producing elements 110, positioned on harp frame 510. The tone producing elements may be arrayed on a tone rail that is movable with respect to the harp frame so that the array may be lifted to access the piano action for tuning or other adjustment. FIG. 4 shows a corresponding array of pickup elements 410 from the rear side, opposite array 520 of tone producing elements 110 and attached to pickup rail 224. Pickup mounting screws 430 allow for translation of each pickup toward and away from the respective tone producing element, as known in the art.

Figure 2:
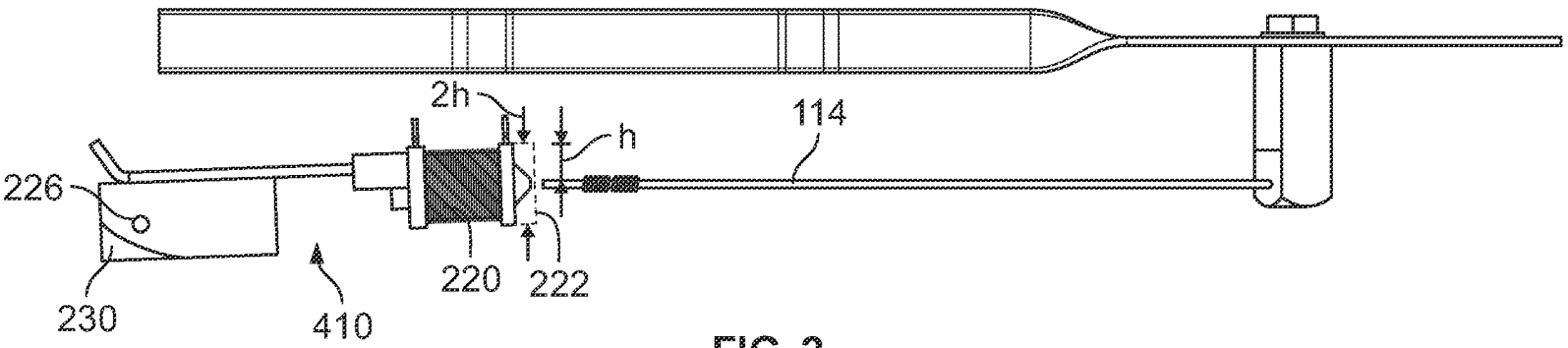
FIG. 2 depicts the adjustable pickup rail in a raised position (harmonic) according to one embodiment.

As shown in FIG. 1 and FIG. 2, pickup elements 410 include a coil 220. Pickup surface area 222 corresponds to a cross section of coil 220, or a projection of the cross section on the end of the pickup. For example, the surface of pickup 410 facing the tone producing element in FIG. 1 and FIG. 2 is a conical end of a core member of the induction coil. The pickup surface area in this instance is a two-dimensional projection, or plan view of the end of the pickup. The cross section of the coil determines the pickup surface area. In embodiments, pickup rail 224 has a range of motion defined at one end of the range by alignment of the longitudinal axis of tine 114 with a center of the pickup surface area 222, being associated with a fully harmonic tone (depicted in FIG. 2), and at another end of the range by alignment of the longitudinal axis of tine 114 with a perimeter of the pickup surface area, being associated with a fully fundamental tone (depicted in FIG. 1), a distance h shown in FIG. 2. However, the fundamental resonance is achieved when the tine is aligned with either the lower edge or upper edge of pickup surface area 222. Therefore, in embodiments, the range of motion of pickup rail 224 may be defined from one side of the perimeter of the pickup surface area to the other, passing from a fundamental tone, through a harmonic tone, to a fundamental tone, a distance of 2 h. This travel may be stopped in between and locked, or repeated.

Figure 3:
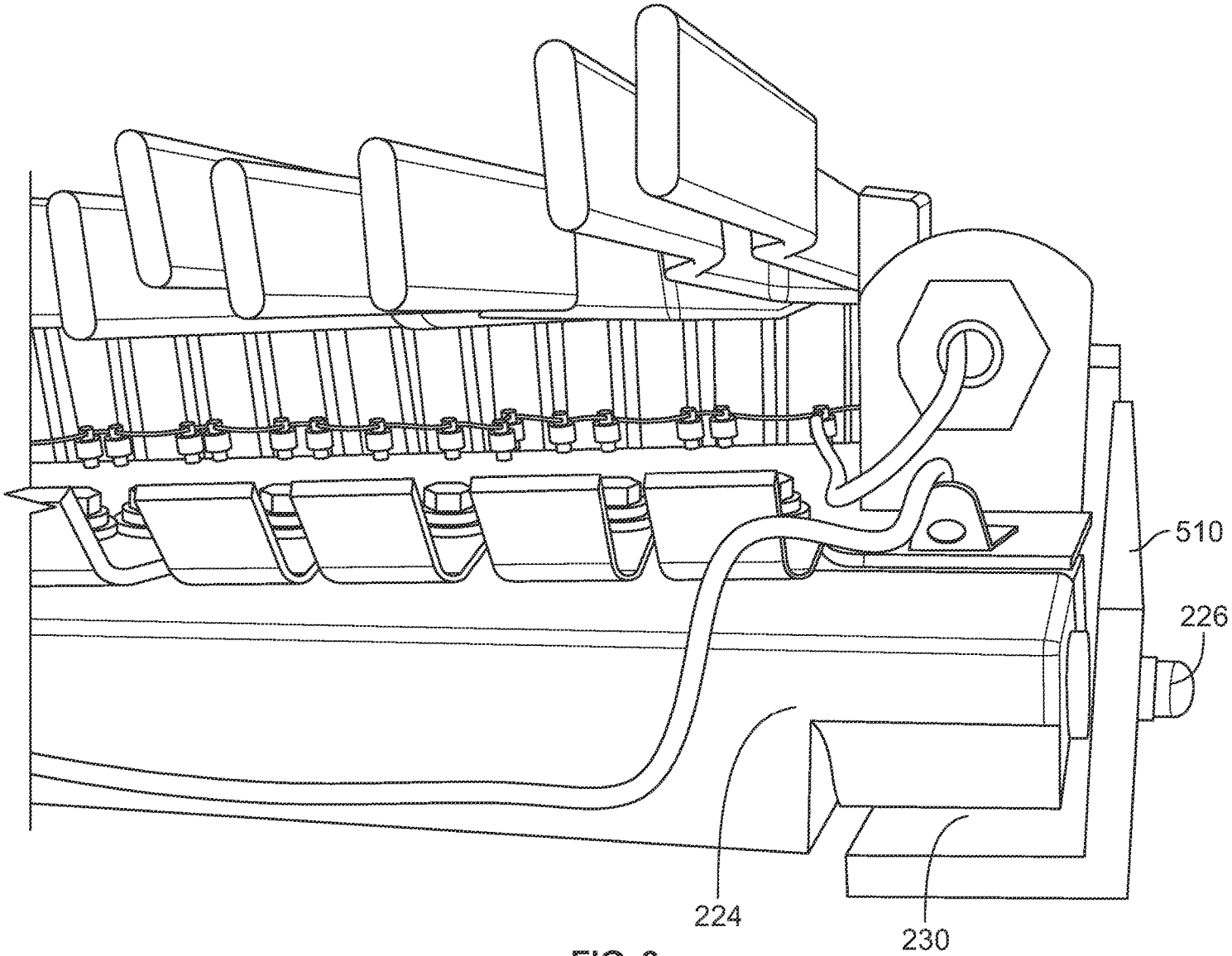
FIG. 3 depicts a relief cut in the pickup rail in relation to the piano harp frame according to one embodiment.

In embodiments, pickup rail 224 has a fulcrum point 226 toward rear side of pickup rail 224 connecting pickup rail 224 to harp frame 510, and pickup rail 224 is adapted to pivot about fulcrum point 226 and move the pickup elements vertically. In an embodiment depicted in FIG. 3, relief cutout 230 on pickup rail 224 provides clearance for the pickup rail against harp frame 510, when the pickup rail is pivoted. The pivoting movement of pickup rail 224 causes the pickup surface area to travel in a slight arc but the difference in distance horizontally between the pickup surface area and the tone source is negligible over the range of motion and the movement is substantially vertical.

In embodiments, pickup rail 224 is sufficiently flexible that a middle portion can be flexed while the ends remain fixed to harp frame 510. The movement of the array of pickups in the middle of the range, and the corresponding change in tone, will affect tone in the middle range notes, where it is frequently most desired, and because the flexing will be less pronounced toward the fixed ends of the pickup rail, the change in tone will be less pronounced or undetectable at the bass and treble ends where the modification may be less desired anyway. In embodiments, an existing electric piano may be fitted with a control arm or other fixture to enable flexing vertical movement of a pickup rail.

In embodiments, pickup rail 224 may be attached to control arm 66 which extends over harp frame 510. One or more stabilizing brackets 68 may be provided, as in a conventional Rhodes design, except that the brackets may be placed higher to allow clearance for the moveable pickup rail. Front end of control arm 66 may be operable by the technician for adjustment and in embodiments by the piano player to allow tonal modifications during a performance. Operation may be mechanized or manual.

Figure 7:
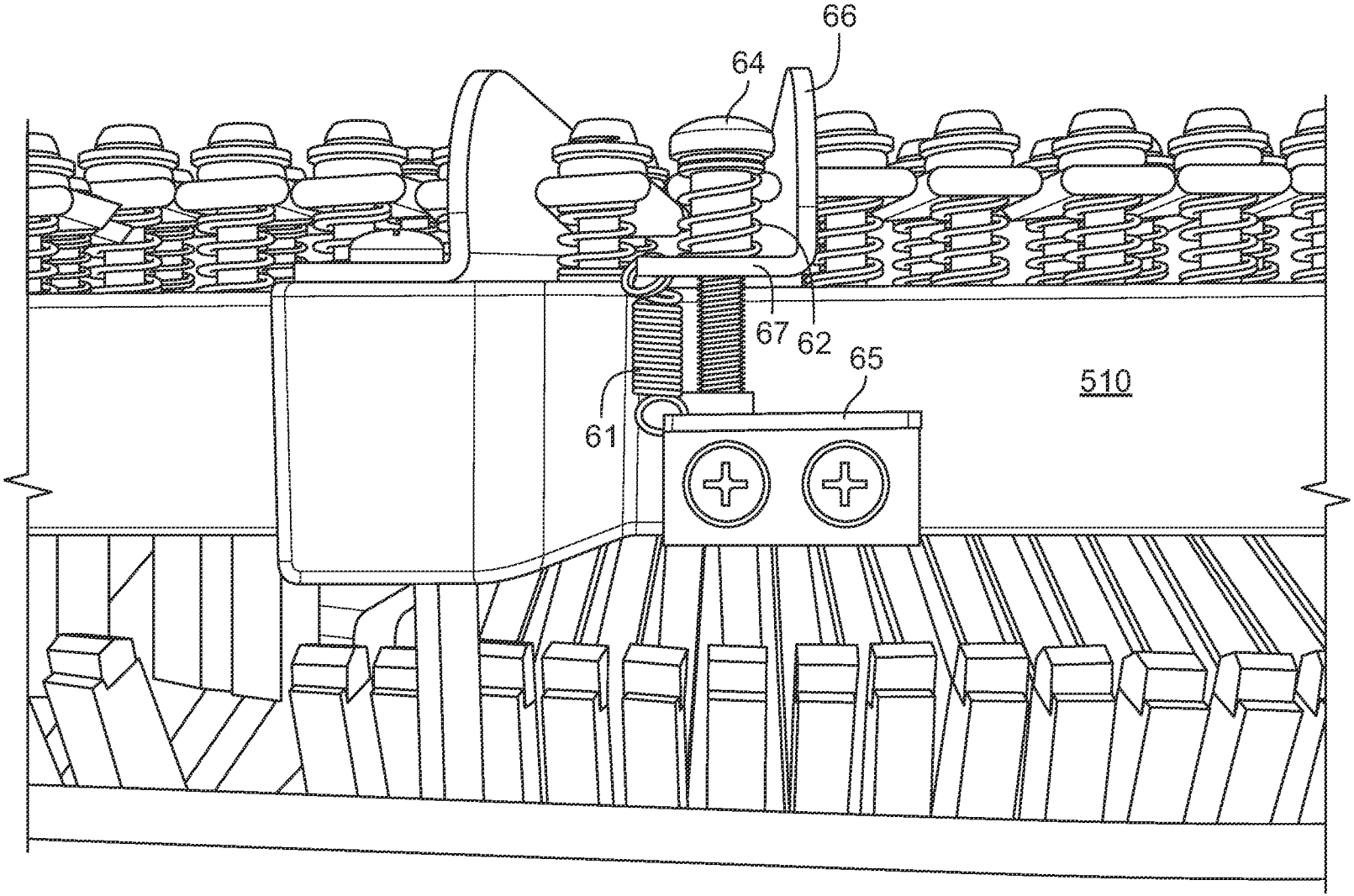
FIG. 7 depicts a locking mechanism for locking the pickup rail in a fixed position relative to the array of tone producing elements, according to another embodiment.
Figure 8:
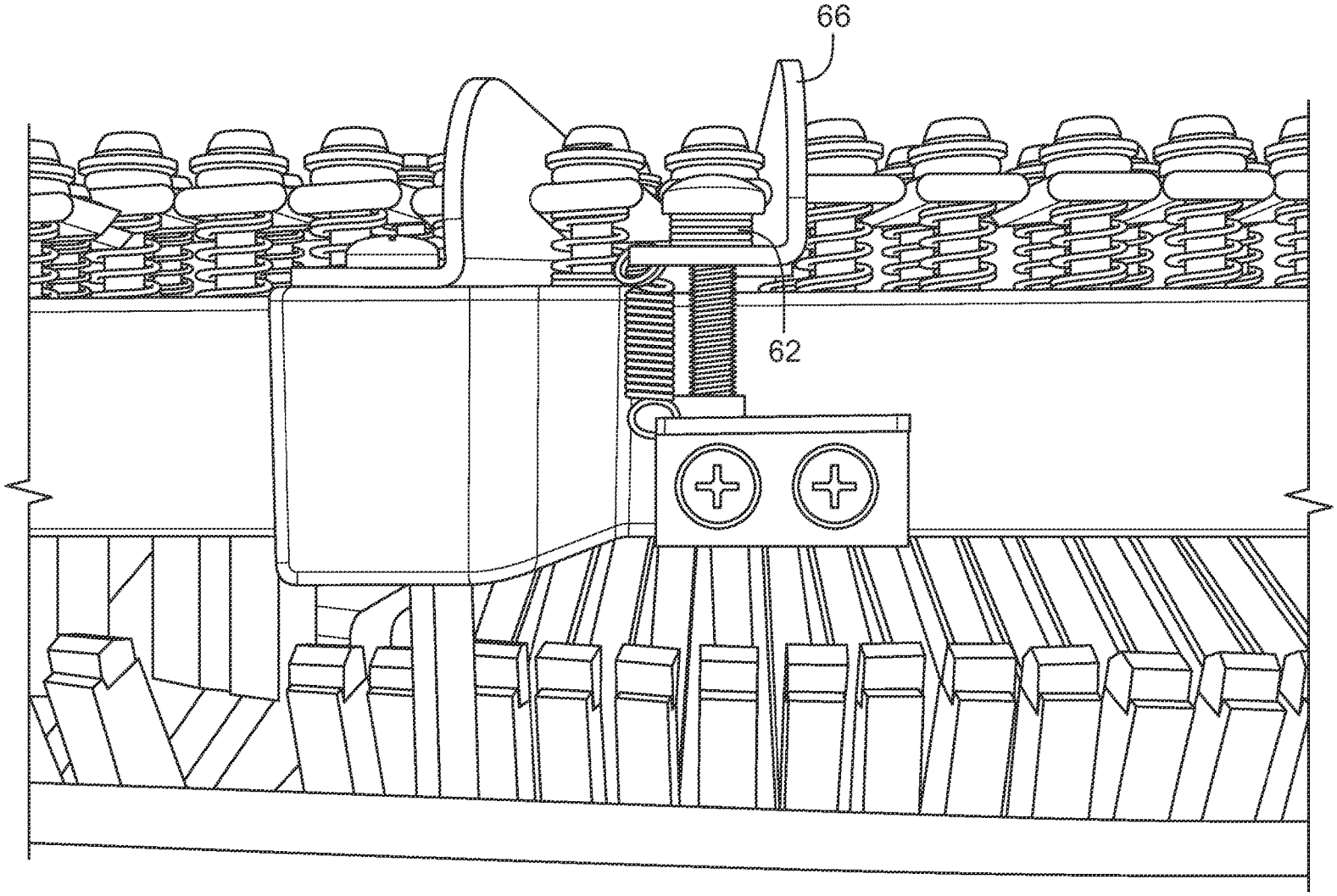
FIG. 8. depicts the locking mechanism of FIG. 7 in a different position according to an embodiment.

A further feature of an electric piano according to embodiments of the invention is a locking screw whereby a vertical position of the pickup rail is adapted to be locked in a user-selected position with respect to the array of tone producing elements. This feature allows the harp assembly to be lifted to access the piano action without altering the relative alignment and relationship of the pickups to the tone producing elements. In an embodiment depicted in FIG. 7 and FIG. 8, lock screw 64 is threaded through control arm 66 which is connected at a first end to the pickup rail and extends over harp frame 510 toward piano keys 535. Locking spring 62 is provided between the head of lock screw 64 and a bracket portion 67 of control arm 66. Lock screw 64 opposite the head abuts bracket platform 65 attached to harp fame 510. In the embodiment shown a piece of felt or other cushioning may be provided at this interface. FIG. 7 shows an unscrewed or lowered position of control arm, and FIG. 8 depicts the maximal lift provided by the locking mechanism Stabilizing spring 61 may be provided elastically joining control arm 66 and bracket platform 65. Spring 62 is under tension and will prevent unwanted vibration of the pickup rail during performance and unwanted movement during transport and allow a smooth transition as locking screw 64 is loosened or locked down.

Figure 6:
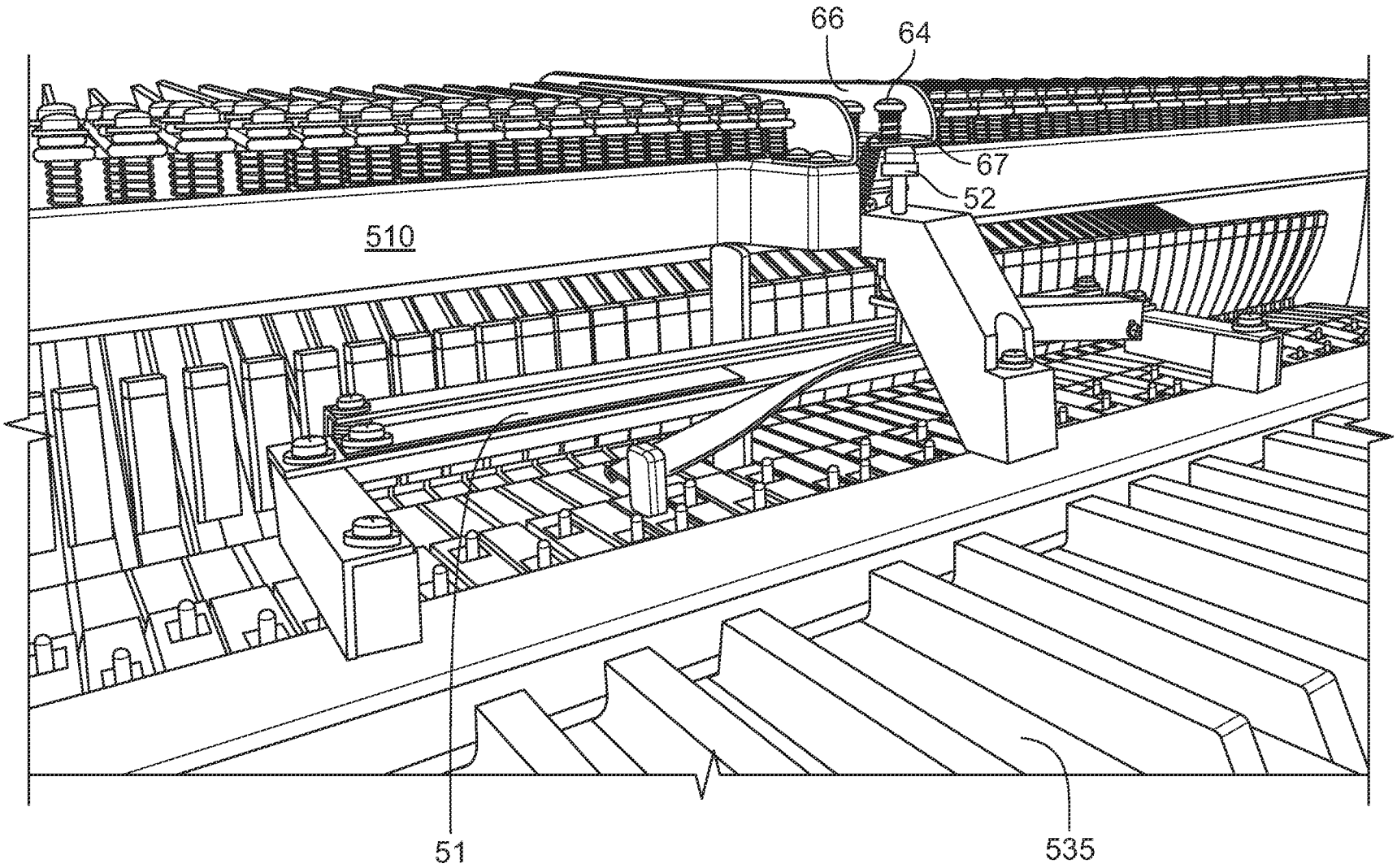
FIG. 6. schematically depicts the mechanism of FIG. 5, showing the position when the pickup rail is raised (harmonic position) according to an embodiment.

According to still another embodiment of the invention, control arm 66 is attached to a slide control unit 51 exterior of harp frame 510 adapted to adjust a vertical position of control arm 66. This may be employed to allow a player greater control of the adjustment or to automate the adjustment on the fly. In the embodiment depicted in FIG. 5 and FIG. 6, pin 52 is adapted to raise control arm 66. On a side opposite control arm 66, pin 52 rests against adjustable ramp 54. In the embodiment depicted, vertical position of control arm 66 (and by extension pickup rail 224) may be controlled by a mechanically assisted horizontal lever 53 which raises and lowers ramp 54 between the positions depicted in FIG. 5 and FIG. 6. In other embodiments, a motorized rack and pinion mechanism could move ramp 54. The mechanism may be operatively connected to a pedal or other actuator. Likewise, a different platform may be provided in place of ramp 54. All such platforms and modes of lifting it, either manually or automatically, to control the pickup rail are within the scope of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An electric piano comprising:

a harp frame, a horizontal array of tone producing elements arranged on the harp frame, each tone producing element comprising an elongated tine having a longitudinal axis, and a resonator;

a horizontal array of keys wherein each key is adapted to activate a respective hammer to strike a respective tine in said array of tone producing elements;

a horizontal array of tone pickup elements opposite the array of tone producing elements, each pickup element having a pickup surface area generally perpendicular to the longitudinal axis of a respective tine element in said array of tone producing elements;

the array of tone pickup elements being connected to a pickup rail moveably connected to the harp frame;

wherein the pickup rail is adjustable vertically to allow for up and down movement of the array of tone pickup elements, thereby adjusting a global vertical alignment of the pickup surface areas with the longitudinal axes of the respective tines.

2. The electric piano according to claim 1, further comprising a control arm connected at a first end to the pickup rail and extending over the harp frame; wherein the pickup rail has a fulcrum point where the pickup rail is connected to the harp frame, and the pickup rail is adapted to pivot about the fulcrum point and move the pickup elements vertically when the control arm is lifted.

3. The electric piano according to claim 2, wherein the pickup rail is fixed to the harp frame and is sufficiently flexible that a middle portion of the pickup rail is movable with respect to the harp frame.

4. The electric piano according to claim 2, comprising a relief cutout on the rear side of the pickup rail to provide clearance for the pickup rail against the harp frame when the pickup rail is pivoted.

5. The electric piano according to claim 1, wherein the pickup rail has range of motion defined at one end of the range by alignment of the longitudinal axis of the tine with a center of the pickup surface area, being associated with a fully harmonic tone, and at another end of the range by alignment of the longitudinal axis of the tine with a perimeter of the pickup surface area, being associated with a fully fundamental tone.

6. The electric piano according to claim 1, wherein the pickup rail has range of motion defined at one end of the range by alignment of the longitudinal axis of the tine with a perimeter of the pickup surface area on a first side of the pickup surface area, above the tine, and at another end of the range by alignment of the longitudinal axis of the tine with the perimeter of the pickup surface area below the tine, so that the pickup travels from a fully fundamental tone to a fully fundamental tone, from one side of the pickup surface area to an opposite side.

7. The electric piano according to claim 1, further comprising a control arm connected at a first end to the pickup rail and extending over the harp frame, and wherein the control arm is attached to a slide control unit exterior of the harp frame adapted to adjust a vertical position of the control arm by sliding the slide control unit.

8. The electric piano according to claim 2, comprising a locking screw connecting and setting a fixed distance between the control arm and a reference point on the array of tone producing elements so that a fixed relative position of the array of tone pickup elements and tone producing elements is maintained when the array of tone pickup elements is lifted.

9. The electric piano according to claim 1, wherein the control arm is operatively connected to a foot pedal adapted to move the pickup rail upward and downward motions by compressing and decompressing the pedal.

10. The electric piano according to claim 7, further comprising a motor to adjust a vertical position of the control arm.

11. The electric piano according to claim 6, wherein an end of the control arm opposite the pickup rail is supported by a pin; said pin supported on a wedge; wherein sliding the wedge horizontally moves the pin and the control lever arm vertically.

12. The electric piano according to claim 1, comprising a locking pin connecting the control arm and the tone bar allowing for lifting the tone bar while maintaining fixed relationship of the pickup rail and the tone rail.

13. A method of globally adjusting an electric piano, said electric piano comprising a horizontal array of tone producing elements arranged on a tone bar on a piano harp frame, each tone producing element having a tine having a longitudinal axis; a horizontal array of tone pickup elements each having a surface area facing and aligned with the longitudinal axis of a respective tine; the plurality of tone pickup elements connected to a pickup rail; said pickup rail connected to a control arm extending from the pickup rail over the harp frame; the method comprising:

lifting and lowering the control arm vertically to allow for up and down movement of the array of pickup elements, changing the alignment of the pickup elements surface areas with the tine.

14. The method according to claim 13, wherein the pickup rail is provided with a fulcrum point and the pickup rail is adapted to pivot about the fulcrum point, and wherein the method comprises: moving the control arm to rotate the pickup rail about the fulcrum point.

15. The method according to claim 13, comprising moving the alignment of the tone producing elements and the facing pickup surface area between a centered harmonic tone position and an off-centered fundamental tone position.

16. The method according to claim 13, comprising removably locking the alignment of the tone producing elements and the facing pickup surface areas of the pickup elements at a position between a centered harmonic tone position and off-centered fundamental tone position.

17. The method according to claim 13, comprising locking the control arm to permit raising the harp assembly while maintaining a fixed relationship of the tone producing elements and the pickup elements.

18. The method according to claim 13, comprising using a motor to raise and lower the pickup rail.

19. An electric piano comprising:

a horizontal array of keys wherein each key is adapted to activate a respective hammer to strike a respective tone producing element;

a horizontal array comprising a plurality of said tone producing elements arranged on a tone rail;

a tone pickup element or array of elements oriented to the array of tone producing elements;

wherein the pickup element or array of elements is globally adjustable with respect to the array of tone producing elements between a fundamental tone producing position and a harmonic tone producing position thereby adjusting global alignment of the pickup elements with the tone producing elements so that a tone of said electric piano across a plurality of notes is adjusted by a user between fundamental and harmonic tones.

* * * * *